US007223046B1

(12) United States Patent
Lim

(10) Patent No.: US 7,223,046 B1
(45) Date of Patent: May 29, 2007

(54) PAVEMENT CRACK INITIATOR

(76) Inventor: Malcolm K. Lim, 109 Bernard Dr., Buffalo Gr, IL (US) 60089

( * ) Notice: Subject to any disclaimer, the term of this patent is extended or adjusted under 35 U.S.C. 154(b) by 74 days.

(21) Appl. No.: 10/827,613

(22) Filed: Apr. 20, 2004

(51) Int. Cl.
*E01C 11/04* (2006.01)

(52) U.S. Cl. ..... 404/53; 404/47; 404/56

(58) Field of Classification Search ..... 404/47, 404/53, 56, 60, 61; 52/718.02
See application file for complete search history.

(56) References Cited

U.S. PATENT DOCUMENTS 2,179,911 A * 11/1939 Wilmoth ..... 404/61
2,269,703 A * 1/1942 Bagwill ..... 404/60
2,572,550 A * 10/1951 White et al. ..... 358/296
2,589,815 A * 3/1952 Jacobson ..... 404/61

OTHER PUBLICATIONS

Design and Construction of Joinrs for Concrete Street APCA, 1992.
Design and Construction of Joints for Concrete Highway APCA, 1991.

* cited by examiner

*Primary Examiner*—Gary S. Hartmann

(57) ABSTRACT

A device to ensure that when the transverse contraction joint in a pavement and the like cracks, the crack extends through the middle of the dowel bar. A dowel is a smooth continuous bar that is embedded in a concrete pavement. It provides vertical shear resistance across a joint. Shortly after the concrete is place and sets, the concrete pavement starts to dry out. The drying out process produces a strain in the concrete pavement due to shrinkage causing the concrete to crack. In order to control the cracking, a saw cut is made in the pavement. The saw cut is centered in the middle of the embedded dowel bar. The saw cut provides a weaken plane in the pavement, thereby controlling the location of the crack. The saw cut and crack form the transverse contraction joint in the pavement. The crack extends from the bottom of the saw cut through the dowel bar to the bottom of the pavement. The crack does not always extend straight down to the bottom of the pavement. The crack typically extends in a diagonal direction down to the bottom of the pavement. This results in a short and long sections of the dowel bar providing shear resistance across the joint. The difference in dowel bar sections results in higher stresses at the shorter end of the dowel bar, shortening the overall life of the pavement. The Pavement Crack Initiator provides a weaken plane in the pavement and ensures that the crack extends through the middle of the dowel bar, evenly distributing the stresses on either side of the dowel bar. With the stress distributed evenly across the joint in the pavement, the joint operates as designed and thereby ensuring the design life of the pavement is achieved.

7 Claims, 4 Drawing Sheets

Prior Art

PAVEMENT CRACK INITIATOR

FEDERALLY SPONSORED RESEARCH

Not Applicable

SEQUENCE LISTING OR PROGRAM

Not Applicable

BACKGROUND

1. Field of Invention

This invention relates to load transfer joints in pavement, to ensure that the crack extends straight down through the middle of the dowel bar and that the load is evenly distributed across the joint.

2. Description of Prior Art

Load transfer across a joint in concrete pavements, is the ability of the joint to transfer a hundred percent of the load across the joint. Factors contributing to load transfer across the joints include aggregate interlock, mechanical load transfer devices, such as a dowel bar and a stabilized sub-base.

Transverse contraction joints are constructed transverse to the centerline. The transverse contraction joints are spaced to control cracking from stresses caused by shrinkage, moisture changes and thermal changes. Dowel bars are placed in across the transverse contraction joint to distribute load over the pavement joint. The dowel bar is a smooth steel rod that provides vertical shear resistance across the joint. Dowel bars are typically placed during construction either in wire baskets assemblies or set in place by an automatic dowel bar inserter. The dowel bar assemblies are frames made out of wire, that support dowels at the proper location. Properly placed dowel bars reduce the stress and deflection on the concrete pavement and the potential for faulting, pumping and corner breaks of the joint. The size of the dowel ranges from 1.25 inches for a pavement slab thickness of up to 10 inches and 1.5 inches diameter for slabs greater than 10 inches thick. The dowels are typically 15 inches to 18 inches long, with an embedment length of 6 times the diameter of the dowel bar. The dowels are placed at mid depth of the pavement slab and are spaced typically at 12 inches apart.

Concrete shrinkage starts shortly after the placement of the concrete pavement. The temperature change in the concrete is the main reason for the shrinkage. Heat of hydration of the cement and temperature change in the concrete pavement typically peaks a short period after the final set of the concrete. Once the concrete temperature has peaked, the core temperature in the pavement will start to decline. This typically happens 12 to 24 hours after the concrete in the pavement is placed. This change in temperature typically induces strain in the pavement and cracks are formed. In order to control the cracking in the pavement, a saw cut is made at regular intervals in the pavement. The saw cut provides a weakened plane in the pavement, which in turn is where the pavement to crack. The saw cut controls the location of the crack in the pavement. It is recommended that the saw cut be approximately ¼ the thickness of the pavement. The saw cut and crack form a controlled joint in the pavement. The saw cut is typically located over the center of the dowel bar. The crack extends from the bottom of the saw cut through the dowel bar to the bottom of the pavement. The crack does not always extend straight down to the bottom of the pavement. The crack extends typically in a diagonal direction down to the bottom of the pavement. This results in a short and long section of the dowel bar providing shear resistance across the joint, which results in higher stresses at the shorter end of the dowel bar. The higher stress in the pavement results in a shortened the life of the pavement.

The location of the saw cut determines the origin of the crack. A saw cut made at the wrong location will result in a crack originating off centered with respect to the position of the embedded dowel bars. The off centered crack will result in a long and short section of dowel bar providing shear resistance across the joint. This results in higher stresses at the shorter end of the dowel bar, which in turn shortens the life of the pavement.

The industry recommendation for the depth of the saw cut is to be one-third to one-quarter the overall thickness of the pavement. The depth recommendation is intended to ensure that the pavement cracks, but does not control the direction of the crack. There is no mechanism to ensure that the pavement crack extends vertically from the bottom of the saw-cut to the bottom of the pavement. A diagonal crack in the pavement joint causes higher stress in the shorter section of the dowel bar, a reduction on the embedment length of the dowel bar in the pavement and reduces the useful life span of the pavement. It is also very difficult to ensure that the depth of the saw cut is satisfactory, since not every saw cut joint is inspected.

Aggregate interlock is defined as "the interlocking action between aggregate particles at the face of the joint." Aggregate interlock is not typically sufficient to transfer a hundred percent of the load across the joint. Thereby a combination of aggregate interlock and dowel bars are typically used to ensure that a hundred percent of the load is transferred across the joint. In order to maximize the load transfer abilities across the joint, a shallower saw cut is needed. This increases the overall surface area of the crack, thereby maximizing the surface area to allow for aggregate interlock. A deeper saw cut will result in a reduction in the overall area for aggregate interlock to occur.

With the current methods of construction, a saw cut less than ⅓ the overall depth of pavement, may not be sufficient to create the weakened plane in the pavement. This results in cracking elsewhere in the pavement, and not at the saw cut. This renders the dowel bars ineffective.

A summary of disadvantages of prior art are:

(a) The saw cut over the dowel bar does not control the direction of the crack.

(b) A diagonal crack results in unequal embedded sections of dowel bars, thus creating higher stress on the shorter section of the dowel bar.

(c) A saw cut made at the wrong location will result in a crack originating off centered with respect to the position of the embedded dowel bars and will result in the crack initiating off centered with respect to the dowel bar. The precise location of the saw cut is highly critical.

(d) A shorter dowel bar section does not meet the embedded length requirements.

(e) Deep saw cut reduces the overall surface area of the crack and thereby reduces the effectiveness of aggregate interlock to transfer the load across the joint.

(f) The expected lifespan of the pavement is typically compromised because of one or more of the above mentioned factors.

SUMMARY OF THE INVENTION

My invention improves load transfer capability of the pavement across the transverse contraction joint. The Pavement Crack Initiator ensures that the crack runs through the center of the dowel bar and at the same time increases the surface area for aggregate interlock at the joint. The embodiment of my invention comprises a tubular clip-on section that snaps onto the dowel bar, winglets that span perpendicular to the tubular section and rigid stabilizing bars to support the winglets. My invention is designed to be attached to dowels that are part of a dowel basket assembly.

During construction of a pavement slab, dowel baskets with dowels attached are placed at specific location in association to the transverse joints locations. The dowel baskets are then anchored to the subbase. These dowel baskets hold the dowels in place, level and at mid height of the slab. The Pavement Crack Initiator is snapped onto the dowels in the dowel baskets at the center of the dowel bar, after the dowel basket is set in place. The winglets should be in line with the middle of the dowel bar. Once the concrete is placed and the pavement is paved, a joint is formed by saw cutting the pavement 12 to 24 hours after the concrete has set. A saw cut is made over the middle of the dowel bar. The saw cut forms a weakened plane in the pavement. The winglets on the Pavement Crack Initiator provide an additional weakened plane inside the pavement. This weakened plane reduces the overall effective depth of pavement at the joint. The effective pavement depth, with the Pavement Crack Initiator in-place, is now limited to the bottom of the saw cut to the top of the winglet. The winglets extend the weakened plane around the dowel bar. The combination of the saw cut and the pavement crack initiator winglet ensures that the pavement cracks at the desired location and the crack extends through the midpoint of the dowel bar. When the crack extends through the midpoint of the dowel bar, the embedment length requirement on the dowel bar is satisfied and stresses are evenly distributed on either side of the dowel bar. The holes on the winglet of the invention allow concrete paste to flow through, ensuring proper consolidation of the concrete around the invention and also the dowel bar. The gap between the stabilizing bar and the winglet allows concrete to flow through and around the pavement crack initiator and dowel bar, ensuring that the concrete is well consolidated and that no voids are present.

The depth of the saw cut required in prior art is typically one quarter the overall thickness of pavement. This causes the presence of a weakened plane in the pavement, thereby causing the pavement to crack. With the pavement crack initiator in place, a weakened plane is introduced into the middle of the pavement, thus a shallower saw cut is required. A shallower saw cut increases the overall surface area for aggregate interlock.

The saw cut will control the location of the origin of the crack. At present, if the location of the saw cut is off center from the center of the dowel bar, there is nothing that will redirect the crack through the center of the dowel bar. With the installation of the pavement crack initiator, the weakened plane in the pavement that is created by the winglets will redirect the crack through the middle of the dowel bar, making the precise location of the sawcuts less critical.

My Pavement Crack Initiator invention can be fabricated at very low cost, either of plastic or metal, due to its simplicity in design. The pavement crack initiator adds no extra cost to the pavement construction cost, because of its many advantages and may even reduce the cost of the pavement joint. The many advantages of my invention ensure that the joint functions as it was intended.

The installation of the invention does not require a great deal of time. The lip at the bottom of the tubular section of my invention ensures that the invention rests evenly on the dowel bar, before it is snapped on. The gap at the top of the Pavement Crack Initiator, between the winglets, allows the Pavement Crack Initiator tubular section to the opened wider, for easy installation. The invention is snapped onto the dowel bar. The winglet allows for the invention to be lined up in the middle of the dowel bars.

The invention provides a savings in several ways:

It ensures that the load is evenly distributed on both sides of the dowel bar, thereby ensuring that the service life of the pavement is not compromised.

A shallower saw cut is required to create a weakened plane in the pavement, allowing the crack to form, and also maximizing the overall surface area for aggregate interlock.

My invention is intended to ensure that the transverse joint will operate as designed, thus reducing the overall maintenance cost over the life of the pavement.

OBJECTS AND ADVANTAGES

Accordingly, my patent offers several advantages over prior art. Several objects and advantages of my invention are:

(a) provides a weakened plane in the concrete pavement, (b) controls the direction and location of the transverse joint crack.

(c) directs the crack through the middle of the dowel bar ensuring even stress distribution on the dowel bars.

(d) ensure that the crack will still extend through the middle of the dowel bar, even though the saw cut is off centered from the embedded dowel bar.

(e) ensures that the embedment length requirements of the dowel bars are met.

(f) a shallower saw cut is needed because the invention reduces the critical pavement area required for cracking, from the bottom of the saw cut to the bottom of the pavement, to the distance between the bottom of the saw cut to the top of the winglets on my invention.

(g) ensures that a shallower saw cut results in a larger surface area for aggregate interlock.

(h) ensures that the installation is quick and easy, simply positioning and snapping it onto the middle of the dowel bar.

(i) ensure that the transverse joint functions as designed.

Further the advantages, usefulness and functionality of my invention will become apparent by referencing the figures and the detailed description listed below.

DRAWINGS

Drawing Figures

Figure 1:
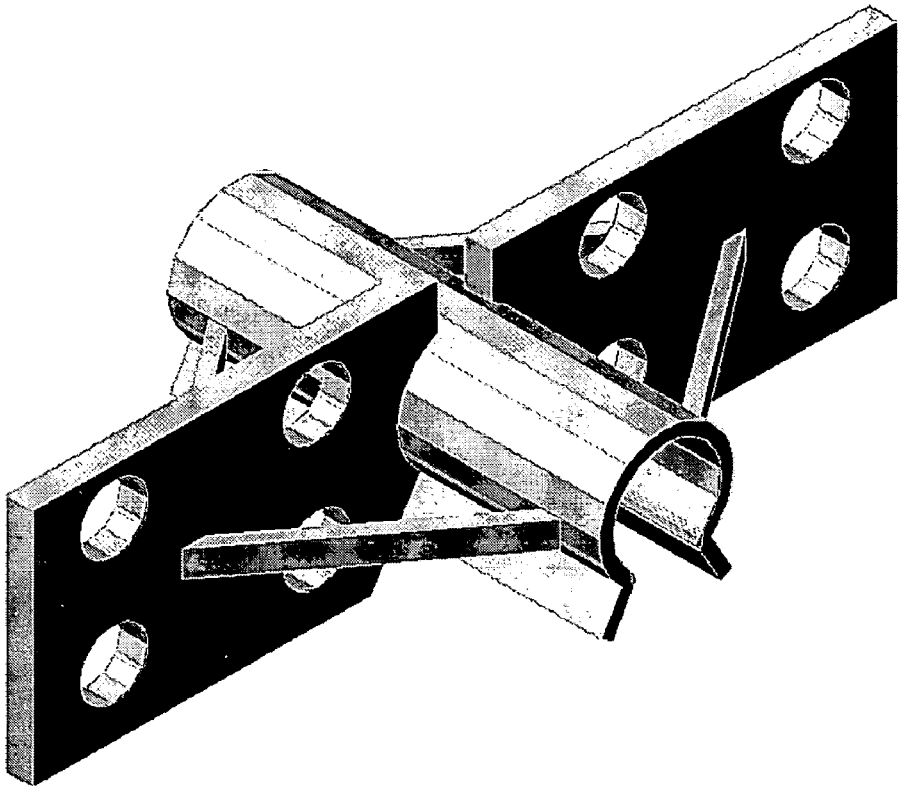
FIG. 1 is a three dimensional view of my invention.
Figure 2:
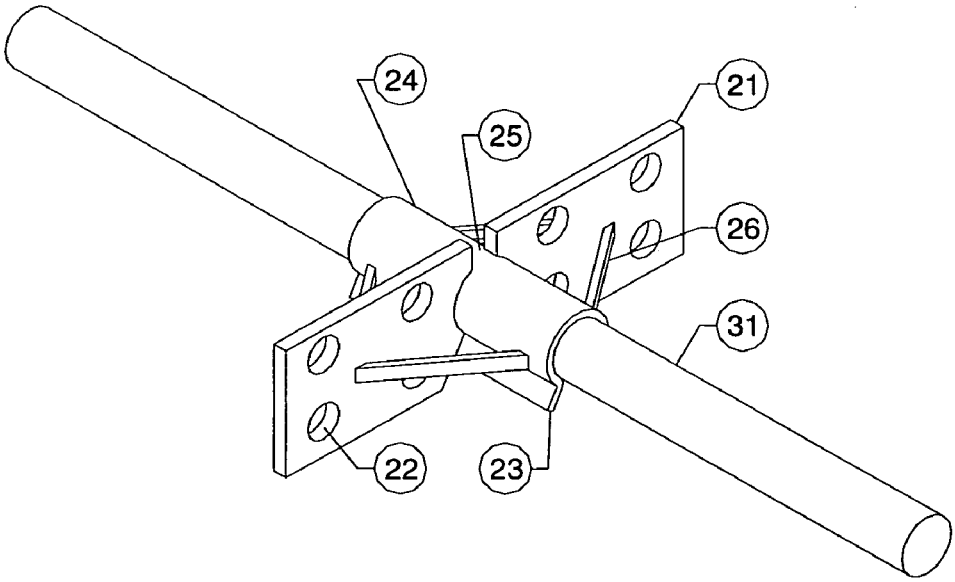
FIG. 2 is a three dimensional view of my invention attached to a dowel bar
Figure 3:
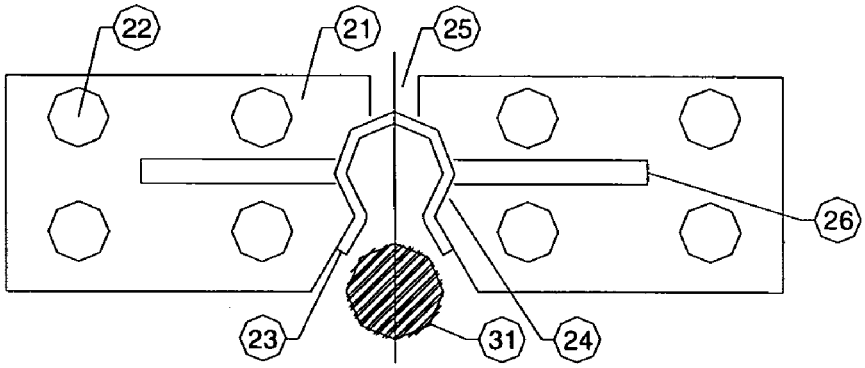

FIG. 3 a cross-section view of my invention, on top of a dowel bar.

Figure 4:
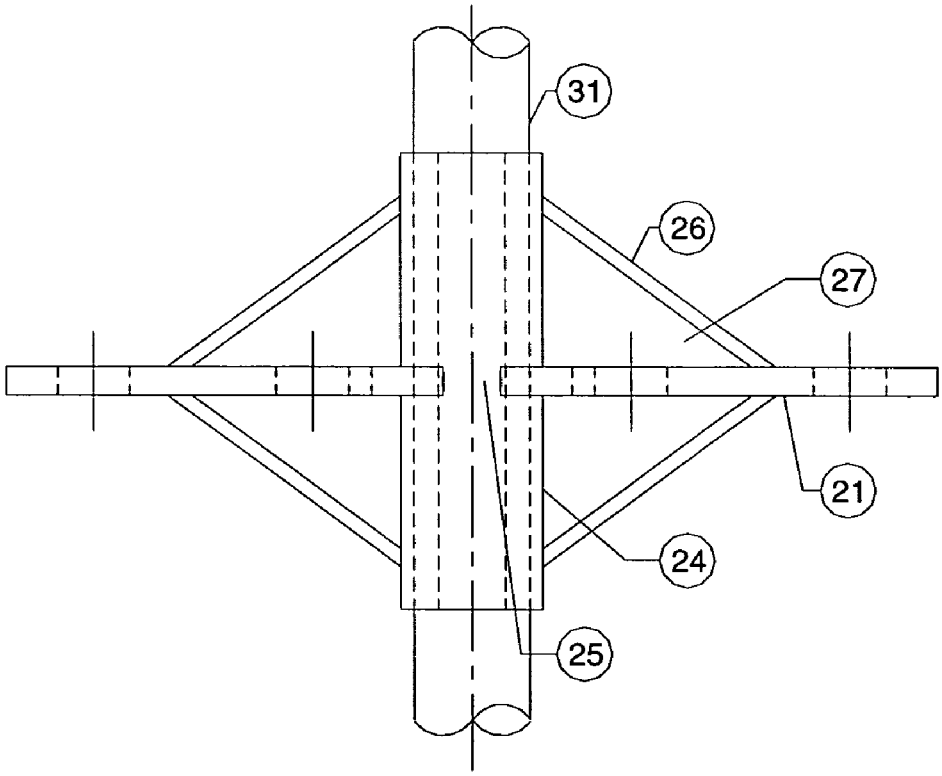

FIG. 4 a top view of my invention, attached to a dowel bar.

Figure 5:
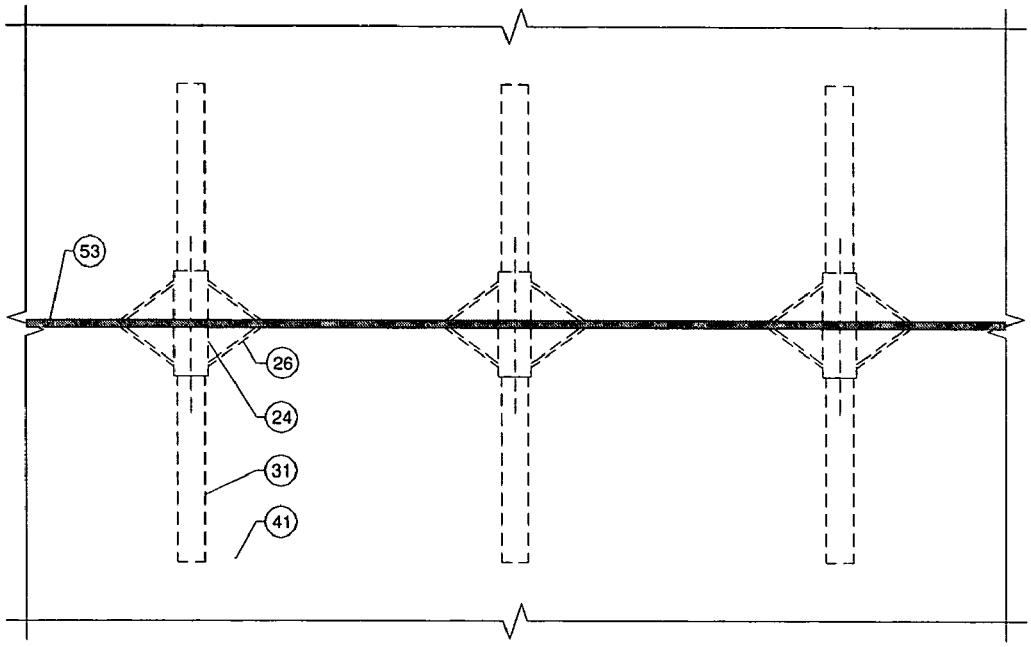

FIG. 5 a top view of the pavement with the pavement crack initiator attached to dowel bars across a pavement joint.

Figure 6:
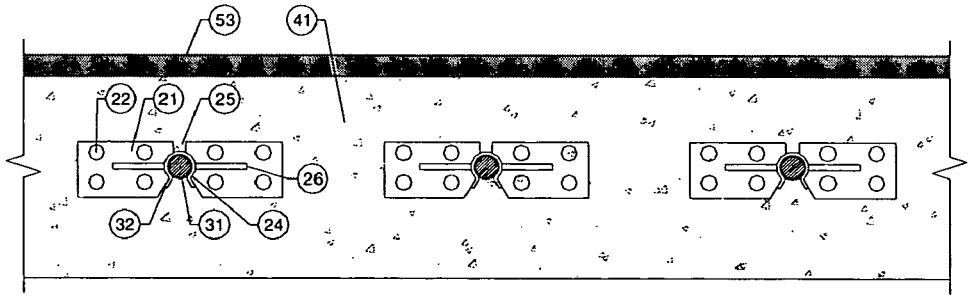

FIG. 6 is a cross section view of a pavement joint showing my invention in place.

Figure 7:
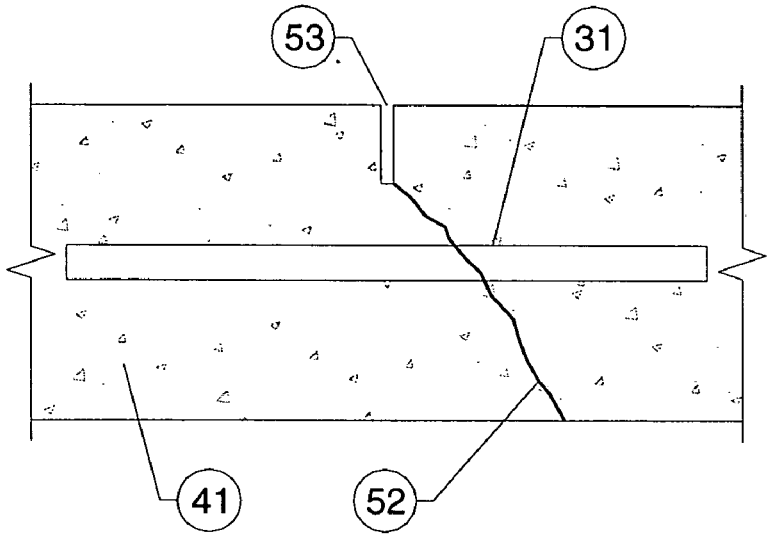

FIG. 7 is a cross section view of a prior art pavement with a crack extending diagonally down to the bottom of the pavement, resulting in a short and long section of dowel bar.

Figure 8:
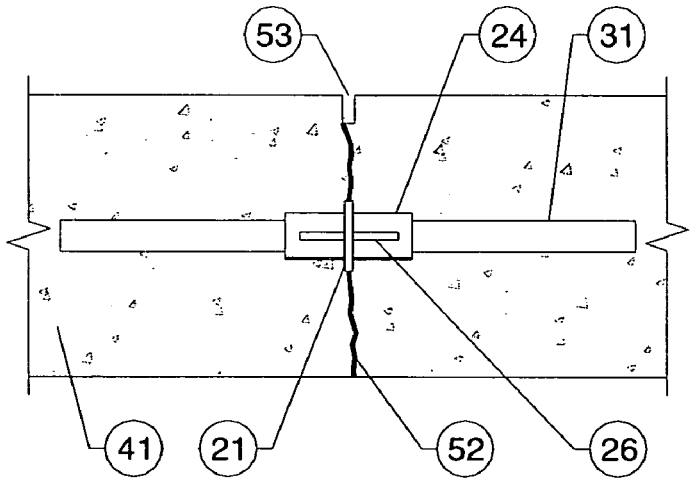

FIG. 8 is a cross section view of the pavement, with my crack initiator installed, with a crack extending straight down to the bottom of the pavement.

REFERENCE NUMERALS IN DRAWINGS

21 winglets
22 holes in winglets
23 lip in tubular section
24 tubular section
25 opening at top of winglets
26 stabilizing bars
27 opening between winglet and stabilizing bars
31 dowel bar
41 pavement
52 crack in pavement
53 saw cut made in the pavement

DETAILED DESCRIPTION

The preferred embodiment of my invention is shown in FIG. 1, FIG. 2, FIG. 3 and FIG. 4. The winglets 21 extend on both sides of the tubular section 24. The gap 25 at the top of my invention, between the winglets 21, allows the tubular section 24 to be opened wider during installation onto the dowel bar 31. The winglets 21 can be used to center my invention onto the dowel bar 31. The lips 23 at the opening of the tubular section 24 provide a wider opening for easy installation onto the dowel bars 31. The lips 23 provide a wider opening to rest onto the dowel bar prior to snapping onto the dowel bar.

The tubular section 24 my invention encapsulates the dowel bar 31. The winglets have holes 22 that allow concrete paste to flow through, thus ensuring the invention is held in place during placement and that proper consolidation of the concrete is attained. The stabilizing bars 26 help reinforce the winglets 21, to keep the winglets in place, as the concrete is being placed. The gap between the stabilizing bars 26 and the winglets 27 allows for concrete paste to fill up around the stabilizing bar 26, ensuring the concrete is well consolidated around my invention and dowel bars 31.

My invention can be used in highway pavement, airport runways, parking lots and the like as long as the joints require a dowel bar 31 to be installed. FIG. 5 shows a plan view of a transverse contraction joint with a saw cut 54 and several dowel bars 31 along with my invention installed. FIG. 6 shows a cross section cut of the pavement 41, at the transverse contraction joint, showing dowel bar 31 along with my invention installed. The cross section of the pavement 41 is positioned at the saw cut 53.

FIG. 7 shows prior art without the invention in installed. The saw cut 53 provides a weaken plane, thereby causing a crack 52 to form. The crack is not restrained in any way and can crack in a diagonal direction 52. This results in a long and short section of dowel bar 31. With my invention, FIG. 8, a shallower saw cut 53 to be made to provide the weaken plane in the pavement 41. With my invention installed, the critical section in the pavement 41 that needs to crack is from the bottom of the saw cut 53 to the top of the winglets 21 on my invention. With the invention in place, the crack 52 extends from the bottom of the saw cut 53 to the top of the winglets 21, down to the bottom of the pavement 41. The invention ensures the crack passes through the middle of the dowel bar 31 and then extend down to the bottom of the pavement 41. The angle at which the crack 52 extends down to the bottom of the pavement 41 can be regarded as inconsequential Having described my pavement crack initiator showing certain specific variation, manufacturing materials, modes of installation, changes in construction will be apparent to those in the art and such changes are considered to call within the scope and spirit of my invention, modes of installation, variation and substitution of material.

I claim:

1. A device for providing a weakened plane in the concrete pavement comprising:

(a) a tubular section with an opening at the bottom;
(b) a set of lips extending outwards from the bottom opening of said tubular section to enlarge the end of the opening;
(c) elongated members of equal lengths extending from the middle of said tubular section and perpendicularly to said tubular section;
(d) a plurality of holes in said elongated members;
(e) means for supporting the elongated members perpendicular to the tubular sections, in the middle of the tubular section;
(f) a gap at the top of said tubular section, between said elongated members.

2. The device according to claim 1, wherein said device is attached to said tubular section in the middle of said dowel bar.

3. The device according to claim 1, wherein said set of lips extends from said tubular section providing a larger opening for ease of anchoring to said dowel bar.

4. The device according to claim 1, wherein said gap at the top of said tubular section allows for said tubular section to be enlarged during installation.

5. The device according to claim 1 is manufactured of metal or plastic.

6. The device according to claim 1, wherein said elongated members are positioned onto the middle of said dowel bar and said tubular section is attached around said dowel bar.

7. The device according to claim 1, wherein said plurality of holes in said elongated members, allows concrete paste to flow into and through, ensuring the concrete around said device is well consolidated.

* * * * *